US006568799B1

(12) United States Patent
Yang et al.

(10) Patent No.: US 6,568,799 B1
(45) Date of Patent: May 27, 2003

(54) DROP-ON-DEMAND INK JET PRINTER WITH CONTROLLED FLUID FLOW TO EFFECT DROP EJECTION

(75) Inventors: Zhihao Yang, Webster, NY (US); Ravi Sharma, Fairport, NY (US); Christopher N. Delametter, Rochester, NY (US); Milton S. Sales, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/055,295

(22) Filed: Jan. 23, 2002

(51) Int. Cl.[7] ..... B41J 2/75
(52) U.S. Cl. ..... 347/85
(58) Field of Search ..... 347/54, 89, 84–87; 251/11; 137/807, 828, 341, 13

(56) References Cited

U.S. PATENT DOCUMENTS

| | | | | |
|---|---|---|---|---|
| 4,237,224 A | | 12/1980 | Cohen et al. | |
| 4,380,770 A | * | 4/1983 | Maruyama | 347/89 |
| 5,023,625 A | * | 6/1991 | Bares et al. | 347/85 |
| 5,252,743 A | | 10/1993 | Barrett et al. | |
| 5,445,008 A | | 8/1995 | Wachter et al. | |
| 5,598,196 A | | 1/1997 | Braun | |
| 5,876,675 A | | 3/1999 | Kennedy | |
| 6,033,059 A | | 3/2000 | Wen et al. | |
| 6,048,498 A | | 4/2000 | Kennedy | |
| 6,055,002 A | | 4/2000 | Wen et al. | |
| 6,074,046 A | | 6/2000 | Wen | |
| 6,102,530 A | | 8/2000 | Kim et al. | |
| 6,152,559 A | * | 11/2000 | Kojima | 347/89 |
| 6,192,939 B1 | | 2/2001 | Yao et al. | |
| 6,240,790 B1 | | 6/2001 | Swedberg et al. | |
| 6,284,113 B1 | | 9/2001 | Bjornson | |
| 6,382,254 B1 | * | 5/2002 | Yang et al. | 137/807 |

FOREIGN PATENT DOCUMENTS

| | | |
|---|---|---|
| WO | WO 01/01025 A2 | 1/2001 |
| WO | WO 01/12327 A1 | 2/2001 |
| WO | WO 01/70400 A1 | 9/2001 |

* cited by examiner

*Primary Examiner*—Judy Nguyen
(74) *Attorney, Agent, or Firm*—Milton S. Sales

(57) ABSTRACT

A drop on demand microfluidic ink jet printing system includes an ink flow chamber having a nozzle opening in a wall of the flow chamber through which ink droplets are ejected when ink in the flow chamber is at or above a predetermined positive pressure. An inlet channel opens into the flow chamber to supply thermally-responsive ink to the flow chamber at or above the predetermined pressure. A microfluidic outlet channel communicates the flow chamber with a low pressure ink reservoir such that thermally-responsive ink is normally transported from the flow chamber at a flow velocity sufficient to maintain ink in the flow chamber at a pressure less than the predetermined positive pressure. A valve selectively restricts the flow of the thermally-responsive ink through the microfluidic outlet channel sufficiently to cause an increase in ink pressure in the flow chamber to at least the predetermined positive pressure, the valve including a heater in contact with at least a portion of the associated microfluidic outlet channel, whereby the viscosity of the thermally-responsive ink can selectively be increased by heat from the heater to restrict the flow of the thermally-responsive ink from the flow chamber such that an ink droplet is ejected through the nozzle opening.

17 Claims, 5 Drawing Sheets

DROP-ON-DEMAND INK JET PRINTER WITH CONTROLLED FLUID FLOW TO EFFECT DROP EJECTION

CROSS REFERENCE TO RELATED APPLICATIONS

Reference is made to commonly assigned co-pending U.S. patent application Ser. No. 09/735,322 filed in the names of Yang et al. on Dec. 12, 2000.

FIELD OF THE INVENTION

This invention generally relates to a drop-on-demand ink jet printer having a droplet separator that includes a mechanism for assisting the selective generation of micro droplets of ink.

BACKGROUND OF THE INVENTION

Drop-on-demand ink jet printers selectively eject droplets of ink toward a printing media to create an image. Such printers typically include a print head having an array of nozzles, each of which is supplied with ink. Each of the nozzles communicates with a chamber that can be pressurized in response to an electrical impulse to induce the generation of an ink droplet from the outlet of the nozzle. Such printers, commercial and theoretically-known, use piezoelectric transducers, thermally-actuated paddles, change in liquid surface tensions, etc. to create the momentary forces necessary to generate an ink droplet. Each of the known technologies has advantages and disadvantages.

The present invention proposes a microfluidic system for providing momentary forces necessary to generate an ink droplet, and to provide an attractive alternative to known technologies. Microfluidic systems are very important in several applications. For example, U.S. Pat. No. 5,445,008 discloses these systems in biomedical research such as DNA or peptide sequencing. U.S. Pat. No. 4,237,224 discloses such systems used in clinical diagnostics such as blood or plasma analysis. U.S. Pat. No. 5,252,743 discloses such systems used in combinatorial chemical synthesis for drug discovery. U.S. Pat. No. 6,055,002 also discloses such systems for use in ink jet printing technology.

SUMMARY OF THE INVENTION

According to a preferred embodiment of the present invention, a drop on demand ink jet printing system includes an ink flow chamber having a nozzle opening in a wall of the flow chamber through which ink droplets are ejected when ink in the flow chamber is at or above a predetermined positive pressure. An inlet channel opens into the flow chamber to supply ink to the flow chamber at or above the predetermined pressure. An outlet channel communicates the flow chamber with a low pressure ink reservoir such that ink is normally transported from the flow chamber at a flow velocity sufficient to maintain ink in the flow chamber at a pressure less than the predetermined positive pressure. A valve selectively restricts the flow of ink through the outlet channel sufficiently to cause an increase in ink pressure in the flow chamber to at least the predetermined positive pressure, whereby an ink droplet is ejected through the nozzle opening.

According to another preferred embodiment of the present invention, a microfluidic system includes a fluid flow chamber having a nozzle opening in a wall of the flow chamber through which fluid droplets are ejected when fluid in the flow chamber is at or above a predetermined positive pressure. An inlet channel opens into the flow chamber to supply thermally-responsive fluid to the flow chamber at or above the predetermined pressure. A microfluidic outlet channel communicates the flow chamber with a low pressure fluid reservoir such that thermally-responsive fluid is normally transported from the flow chamber at a flow velocity sufficient to maintain fluid in the flow chamber at a pressure less than the predetermined positive pressure. A valve selectively restricts the flow of the thermally-responsive fluid through the microfluidic outlet channel sufficiently to cause an increase in fluid pressure in the flow chamber to at least the predetermined positive pressure, the valve including a heater in contact with at least a portion of the associated microfluidic outlet channel, whereby the viscosity of the thermally-responsive fluid can selectively be increased by heat from the beater to restrict the flow of the thermally-responsive fluid from the flow chamber such that an fluid droplet is ejected through the nozzle opening.

According to still another preferred embodiment of the present invention, a drop on demand microfluidic ink jet printing system includes an ink flow chamber having a nozzle opening in a wall of the flow chamber through which ink droplets are ejected when ink in the flow chamber is at or above a predetermined positive pressure. An inlet channel opens into the flow chamber to supply thermally-responsive ink to the flow chamber at or above the predetermined pressure. A microfluidic outlet channel communicates the flow chamber with a low pressure ink reservoir such that thermally-responsive ink is normally transported from the flow chamber at a flow velocity sufficient to maintain ink in the flow chamber at a pressure less than the predetermined positive pressure. A valve selectively restricts the flow of the thermally-responsive ink through the microfluidic outlet channel sufficiently to cause an increase in ink pressure in the flow chamber to at least the predetermined positive pressure, the valve including a heater in contact with at least a portion of the associated microfluidic outlet channel, whereby the viscosity of the thermally-responsive ink can selectively be increased by heat from the heater to restrict the flow of the thermally-responsive ink from the flow chamber such that an ink droplet is ejected through the nozzle opening.

DETAILED DESCRIPTION OF THE INVENTION

Figure 1:
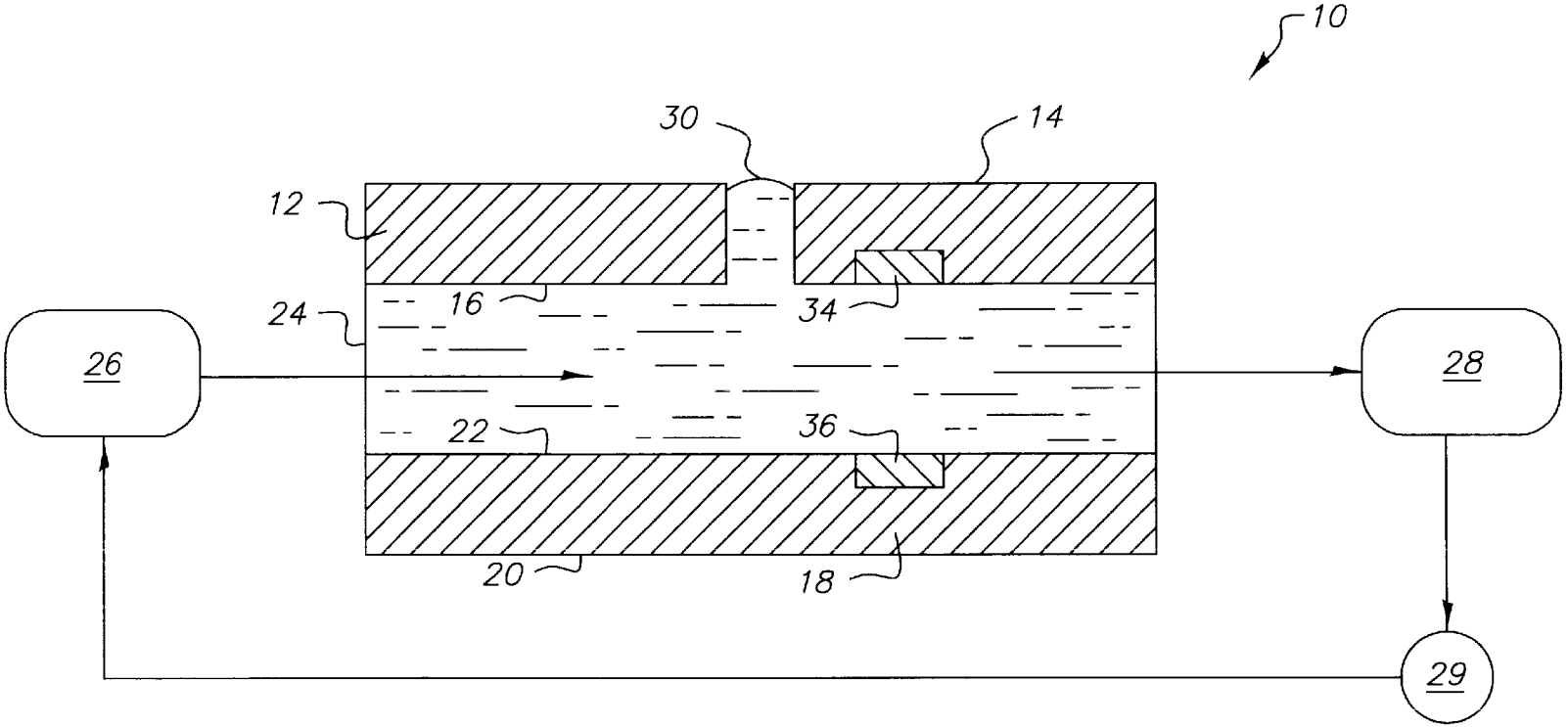
FIG. 1 is a schematic cross-sectional side view of a nozzle in a drop-on-demand print head that utilizes a thermally-actuated valve according to an embodiment of the present invention.

With reference to FIG. 1, a print head 10 includes a nozzle plate 12 having an outer surface 14 and an inner surface 16. A back substrate 18 has an outer surface 20 and an inner surface 22. Nozzle plate 12 and back substrate 18 may be silicon, glass, quartz, ceramics, or polymeric substrates such as plastics (polyamide, polymethylmethacrylate (PMMA), polycarbonate, polytetrafluoroethylene, Teflon®, polydimethylsiloxane (PDMS), polyvinylchloride (PVC), polysulfone, etc.). Inner surfaces 16 and 22 define an ink flow passage 24 through which is caused to flow from a pressurized source 26 to a low pressure reservoir 28. Nozzle plate 12 has plurality of circular nozzles 30, only one of which is shown. Each nozzle has its own dedicated ink flow passage. The liquid ink forms a meniscus 32 around the upper side walls of nozzle 30. Depending on the pressure of the ink at the nozzle opening, the meniscus may be concave or convex, but it is thought that best operation will be obtained by keeping the ink pressure at the opening just below that necessary to overcome the surface tension of the ink to cause ejection of a droplet from the nozzle. Ink pressure at the nozzle opening is a function of the pressures of source 26 and reservoir 28, frictional losses through flow passage 24, and the Bernoulli effect of ink flow past nozzle 30. A pump 29 maintains a sufficient pressure differential to maintain flow through the system.

A pair of heaters 34 and 36 is positioned on inner surfaces 16 and 22, respectively, such that a microfluidic valve is formed in ink flow passage 24 to ink flow there through. A single heater could extend substantially around ink flow passage 24. The term, "microfluidic", "microscale" or "microfabricated" generally refers to structural elements or features of a device, such as ink flow passage 24, having at least one fabricated dimension in the range from about 0.1 $\mu$m to about 500 $\mu$m. In devices according to the present invention, microscale ink flow passage 24 preferably have at least one internal cross-section dimension, e.g., depth, width, length, diameter, etc., between about 0.1 $\mu$m to about 500 $\mu$m, preferably between about 1 $\mu$m to about 200 $\mu$m.

Heaters 34 and 36 are preferably made from appropriately doped polysilicon, is fabricated on surfaces 16 and 22, respectively. A conducting material, not shown, such as aluminum or copper, is also integrated to serve as wires to connect the heaters to an external power supply. In a preferred embodiment of the invention, the microfluidic devices are fabricated using CMOS compatible fabrication techniques, and the heaters are integrated with a CMOS circuit on the chip, which controls the signals or voltages applied to the heaters to activate the valve.

The print heads of the present invention are preferably fabricated with the techniques commonly associated with the semiconductor electronics industry, e.g., photolithography, dry plasma etching, wet chemical etching, etc., on the surface of a suitable substrate material, such as silicon, glass, quartz, ceramics, as well as polymeric substrates, e.g., plastics. In a preferred embodiment of the invention, print heads comprise two or more layers of fabricated components that are appropriately mated or joined together.

Various techniques using chip technology for the fabrication of microfluidic devices, and particularly micro-capillary devices, with silicon and glass substrates have been discussed by Manz, et al. (*Trends in Anal. Chem.* 1990, 10, 144, and *Adv. In Chromatog.* 1993, 33, 1). Other techniques such as laser ablation, air abrasion, injection molding, embossing, etc., are also known to be used to fabricate microfluidic devices, assuming compatibility with the selected substrate materials.

The function of a microfluidic valve is to control the flow rate or volume flux of a liquid through a micro-capillary channel. In general, for a fluid with a viscosity of $\mu$ that is driven through a micro-capillary channel with a length of L by a pressure of P, the volume flux, Q, of the liquid pass through the channel is:

$$Q = \frac{P}{\mu L} \cdot f,$$

whereof is the dimension factor of the cross-section for the microfluidic channel. For a circular cross-section capillary channel with a radius r:

$$f_c = \frac{\pi r^4}{8},$$

while for a rectangular cross-section channel with a width a, height b and aspect ratio $\eta$=b/a ($\eta \geqq 1$), $$f_R = a^4\left[\frac{\eta}{12} - \frac{16}{\pi^5}\tanh\left(\frac{\pi}{2}\eta\right)\right].$$

It is generally true that the flow rate or the volume flex is inversely proportional to the internal viscosity of fluid in the channel. Therefore, if one can control the viscosity of the fluid in the channel, one can indeed control the flow rate of the fluid passing though the channel.

The microfluidic delivery system of the present invention has a microfluidic valve that utilizes the property of a specially formulated thermally-responsive fluid serving as the carrier fluid for transport of subject materials through a microfluidic channel such as ink flow passage 24. The viscosity of the formulated thermally-responsive fluid is sensitive to the temperature, and preferably increases with the increase of temperature.

The "subject materials" simply refers to the materials, such as chemical or biological compounds, of interest, which may also include a variety of different compounds, including chemical compounds, mixtures of chemical compounds, e.g., a dye, a pigment, a protein, DNA, a peptide, an antibody, an antigen, a cell, an organic compound, a surfactant, an emulsion, a dispersion, a polysaccharide, colloidal particles, organic or inorganic compounds, nucleic acids, or extracts made from biological materials, such as bacteria, plains, fungi, or animal cells or tissues, naturally occurring or synthetic compositions. In the preferred embodiment of the present invention, the subject material is a printing dye or pigment.

The thermally-responsive material may comprise at least one kind of block copolymer with at least one block comprising poly(ethylene oxide), commonly referred to as PEO. In another form, the thermally-responsive material comprises a tri-block copolymer of poly(ethylene oxide)-poly (propylene oxide)-poly(ethylene oxide), commonly referred to as PEO-PPO-PEO dissolved in an aqueous solution. The preferred concentrations of the solutions are from about 5% to about 80%, preferably from 10% to 40% in weight.

The solutions at room temperature, e.g., 22° C., are fluidic with a typical viscosity less than 10 centipoise. The viscosity of the formulated solutions increases dramatically when raising the temperature from about 30° C. to about 80° C., as the solutions rapidly form non-fluidic gels at the elevated temperature. The viscosity change of the formulated solutions in response of temperature change is entirely reversible as the solutions turn to fluidic having the original viscosity when cooled down to its initial temperature.

In yet another form, a methyl cellulose polymer may be used as a thermally-responsive material in the carrier fluid. For example, 2.75 wt. % solution of METHOCEL® K100LV (Dow Chemical Co.) having a viscosity of about 1 poise at 50° C. and a viscosity of more than 10 poise at 75° C. can be used.

EXAMPLE 1

Viscosity vs. Temperature of Thermally-responsive Solutions

Thermally-responsive solutions were formulated by dissolving a tri-block copolymer of poly(ethylene oxide)-poly(propylene oxide)-poly(ethylene oxide), or PEO-PPO-PEO in an aqueous solution. A series of the PEO-PPO-PEO tri-block copolymers were obtained from BASF under the product trade name of Pluronic®.

A Rheometrics ARES Fluids Spectrometer, from Rheometric Scientific, Inc., equipped with a corvette geometry, was used to measure the oscillatory shear properties of the Pluronic® solutions. Dynamic viscosity was measured continuously as the temperature was ramped from 20° C. to 80° C. The typical ramp rate was 1° C. per minute. The fluids were initially characterized at 20° C. in a continuous shear experiment covering a typical range of shear rates from 1 to 100 per second. All were found to have low viscosity and Newtonian response. For the temperature scan experiments, a monitoring frequency of 10 radians per second was used.

The results are shown in the following tables:

TABLE 1

| | Viscosity (Poise) of Pluronic ® P85 Solutions | | |
|---|---|---|---|
| Temperature (° C.) | 20% | 15% | 10% |
| 25 | 0.09 | 0.037 | 0.022 |
| 30 | 0.112 | 0.033 | 0.017 |
| 35 | 0.113 | 0.031 | 0.014 |
| 40 | 0.096 | 0.026 | 0.012 |
| 45 | 0.079 | 0.022 | 0.01 |
| 50 | 0.066 | 0.019 | 0.008 |
| 55 | 0.054 | 0.016 | 0.007 |
| 60 | 0.05 | 0.014 | 0.006 |
| 62 | 0.069 | 0.016 | 0.007 |
| 64 | 0.143 | 0.029 | 0.011 |
| 66 | 0.382 | 0.065 | 0.022 |
| 68 | 1.283 | 0.185 | 0.059 |
| 70 | 5.176 | 0.792 | 0.194 |
| 72 | 15.018 | 3.684 | 0.821 |
| 74 | 31.802 | 11.303 | 3.534 |
| 76 | 46.005 | 21.505 | 9.134 |
| 78 | 52.008 | 28.574 | 13.39 |
| 80 | 51.921 | 30.369 | 17.917 |

TABLE 2

| Viscosity of 25% Pluronic ® L62 Solution | |
|---|---|
| Temperature (° C.) | Viscosity (Poise) |
| 22 | 0.072 |
| 25 | 0.068 |
| 28 | 0.069 |
| 30 | 0.073 |
| 32 | 0.081 |

TABLE 2-continued

| Viscosity of 25% Pluronic ® L62 Solution | |
|---|---|
| Temperature (° C.) | Viscosity (Poise) |
| 34 | 0.1 |
| 36 | 0.136 |
| 38 | 0.237 |
| 40 | 0.44 |
| 42 | 0.834 |
| 44 | 0.976 |
| 46 | 1.777 |
| 48 | 5.864 |
| 49 | 26.704 |
| 50 | 37.107 |
| 52 | 40.677 |
| 54 | 35.045 |
| 56 | 31.245 |

TABLE 3

| Viscosity of 22% Pluronic ® F87 Solution | |
|---|---|
| Temperature (° C.) | Viscosity (Poise) |
| 22 | 0.201 |
| 25 | 0.242 |
| 30 | 0.525 |
| 32 | 0.696 |
| 34 | 0.968 |
| 36 | 1.225 |
| 37 | 1.505 |
| 38 | 385 |
| 39 | 13873 |
| 40 | 17046 |
| 41 | 15056 |
| 42 | 14963 |
| 45 | 14512 |
| 50 | 15008 |
| 55 | 15509 |

The above results show that the Pluronic® P85 solutions with the concentrations from 10% to 20% have viscosity increases of more than 3 orders of magnitude when the temperature increases from 60° C. to 80° C., the 25% Pluronic® L62 solution has a 3 orders of magnitude viscosity increase with temperature from 30° C. to 50° C., and the 22% Pluronic® F87 solution has a more than 5 orders of magnitude viscosity increase with temperature from 30° C. to 40° C. The results demonstrated that these fluids are thermally-responsive and can be used in the device and method of the invention.

EXAMPLE 2

A Set of Thermally Responsive Inks with Cyan, Magenta, Yellow, and Black (CMYK) Colors The thermally responsive inks were formulated by dissolving 15% wt of Pluronic® P85 in an aqueous solution. For black ink, a 5% wt dye of Food Black2 was added, for cyan ink a 6% wt dye of Avecia ProJet® Cyan Fast2 was added, for magenta ink a 5% wt dye of Tricon acid Red52 was added, and for yellow ink a 5% wt dye of acid Yellow was added.

The viscosity vs. temperature measurements of thermally responsive inks were carried as descript above in Example 1 and the results are shown in Table 4

TABLE 4

Viscosity vs. temperature of the thermally responsive inks

| | Viscosity (CentiPoise) of Thermally Responsive Inks | | | |
|---|---|---|---|---|
| Temperature (° C.) | Black | Cyan | Magenta | Yellow |
| 25 | 6.9 | 5.1 | 5.1 | 6.1 |
| 60 | 3.2 | 2.0 | 2.1 | 2.8 |
| 85 | 3200 | 3100 | 41 | 30 |

The above results show that all the formulated thermally responsive inks have viscosities less than 7 centipoise from room temperature to about 60° C. and have viscosities more than 30 centipoise at 85° C. The black and cyan inks even have viscosities more than 3000 centipoise at 85° C. The results demonstrated that these inks are thermally responsive and can be used in the method of the invention.

In operation, dye or pigment in a specially formulated thermally-responsive carrier fluid is transported through ink flow passage 24 past nozzle 30 and microfluidic valve heaters 34 and 36. The liquid forms meniscus 32 around the upper side walls of nozzle 30. Depending on the pressure of the liquid at the nozzle opening, the meniscus may be concave or convex, but it is thought that best operation will be obtained by keeping the ink pressure at the opening just, below that necessary to overcome the surface tension of the ink to cause ejection of a droplet from the nozzle. Ink pressure at the nozzle opening is a function of the pressures of source 26 and reservoir 28, frictional losses through flow passage 24, and the Bernoulli effect of ink flow past nozzle 30.

Droplets are emitted from nozzle 30 by applying electrical pulses to heaters 34 and 36 causing heat generated by the heaters to be transmitted to the solution. The viscosity of the formulated solution increases dramatically when raising the temperature from about 30° C. to about 80° C., as the solutions rapidly form non-fluidic gels at the elevated temperature. The increased viscosity quickly forms a gel, blocking the right side of ink flow passage 24 and increasing the pressure at nozzle 30. The increased pressure overcomes the surface tension on the meniscus, causing a droplet to be generated. Details of droplet generation will be illustrated in detail herein below with respect to another embodiment of the invention. The end result is that an ink droplet is expelled at a high velocity from the nozzle outlet, which in turn causes it to strike its intended position on a printing medium with greater accuracy.

The viscosity change of the formulated solutions in response of temperature change is entirely reversible as the solutions turn to fluidic having the original viscosity when cooled down to its initial temperature. Flow resumes through the right side of passage 24 and the pressure returns to a level incapable of droplet formation.

Figure 2:
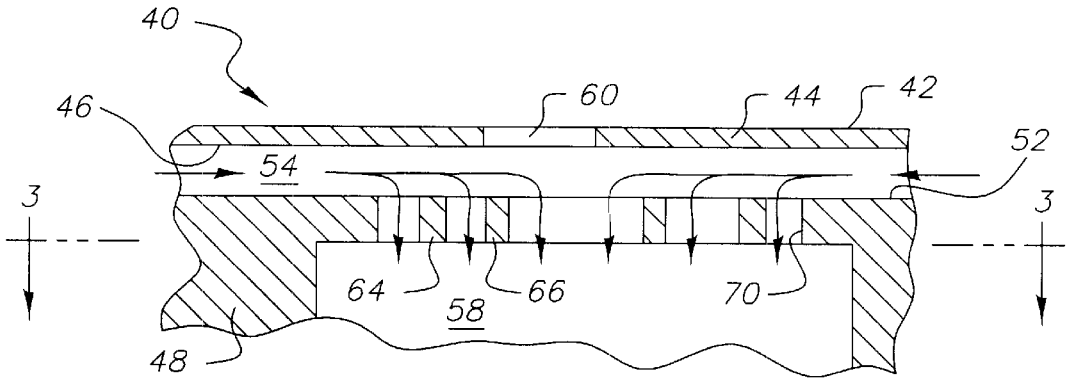
FIG. 2 is a cross-sectional side view of a print head according to another embodiment of the present invention.
Figure 3:
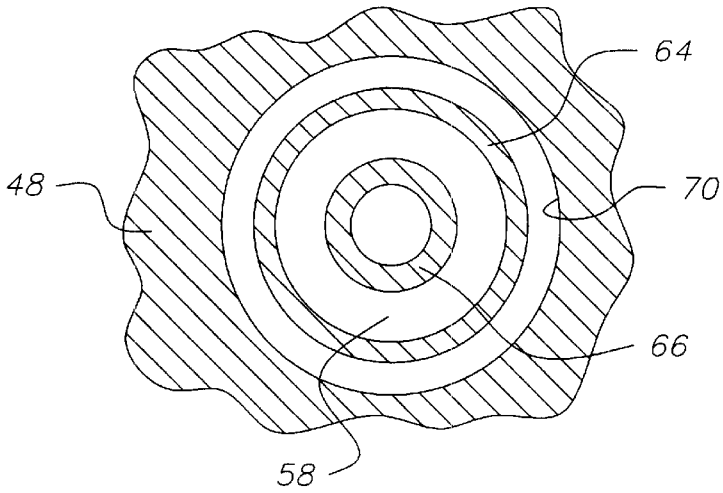
FIG. 3 is a cross-sectional top view taken along section line 3—3 of FIG. 2.

FIG. 2 is a side sectional view of a print head according to another embodiment of the present invention. FIG. 3 is a cross-sectional top view taken along section line 3—3 of FIG. 2. A print head 40 includes a nozzle plate 44 having an outer surface 42 and an inner surface 46. A back substrate 48 has an inner surface 52. Inner surfaces 46 and 52 define an ink flow passage 54 through which is caused to flow from a pressurized source, not shown, to a low pressure reservoir 58. Nozzle plate 44 has plurality of circular nozzles 60, only one of which is shown. Each nozzle 60 has its own dedicated ink flow passage in fluid isolation one from another. The plural nozzles are spaced from each other at least sufficiently that the flow passages of adjacent nozzles do not interfere with its neighbor.

Figure 4A:
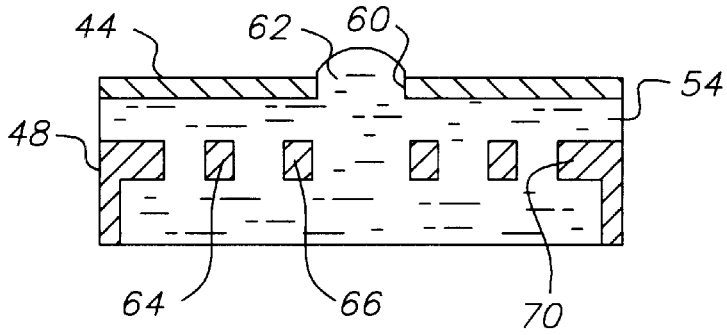
FIGS. 4A–4D illustrate the development and release of a liquid droplet from the print head of FIGS. 2 and 3.

As illustrated in FIG. 4A, the liquid ink forms a meniscus 62 around the upper side walls of nozzle 60. Depending on the pressure of the ink at the nozzle opening, the meniscus may be concave or convex. It is thought that best operation will be obtained by keeping the ink pressure at the opening just below that necessary to overcome the surface tension of the ink to cause ejection of a droplet from the nozzle. Ink pressure at the nozzle opening is a function of the pressures of the ink source and reservoir 58, frictional losses through flow passage 54, the Bernoulli effect of ink flow past nozzle 60 and, referring again to FIGS. 2 and 3, the amount of flow restriction imposed by a micro-capillary grill made up of a plurality of heater rings shown schematically as rings 64 and 66.

The heater rings are positioned in back substrate 48 such that the micro-capillary grill forms a microfluidic valve in the ink flow path between passage 54 and reservoir 58. The flow passages of the grill has radial opening dimensions in the range from about 0.1 $\mu$m to about 500 $\mu$m, preferably between about 1 $\mu$m to about 200 $\mu$m. Conducting material, not shown, such as aluminum or copper, is integrated to serve as wires to connect the heater rings to an external power supply. The microfluidic valve controls the flow rate or volume flux of liquid through the micro-capillary grill; the flow rate or the volume flex being inversely proportional to the internal viscosity of fluid in the channel. The viscosity of the formulated thermally-responsive fluid is sensitive to the temperature, and preferably increases with the increase of temperature.

Figure 4B:
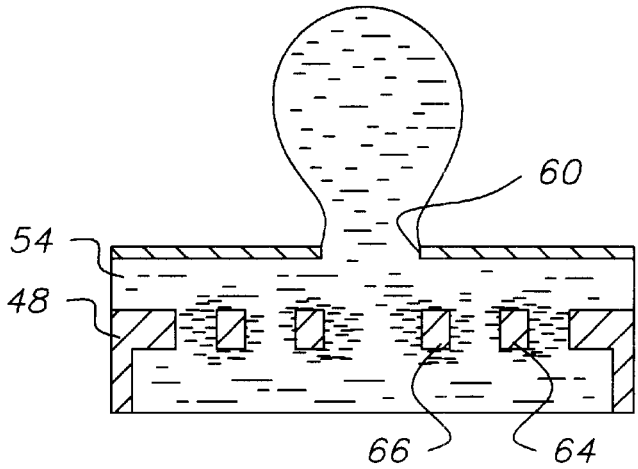
Figure 4C:
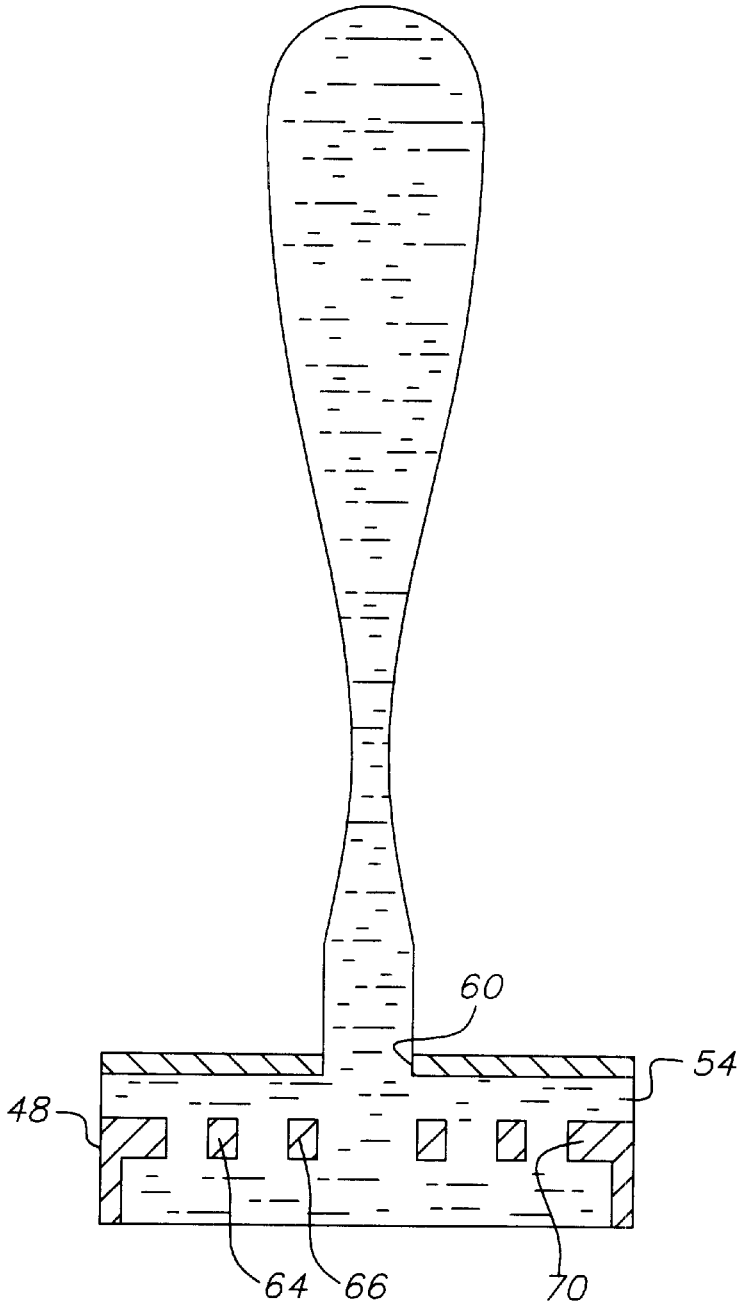
Figure 4D:
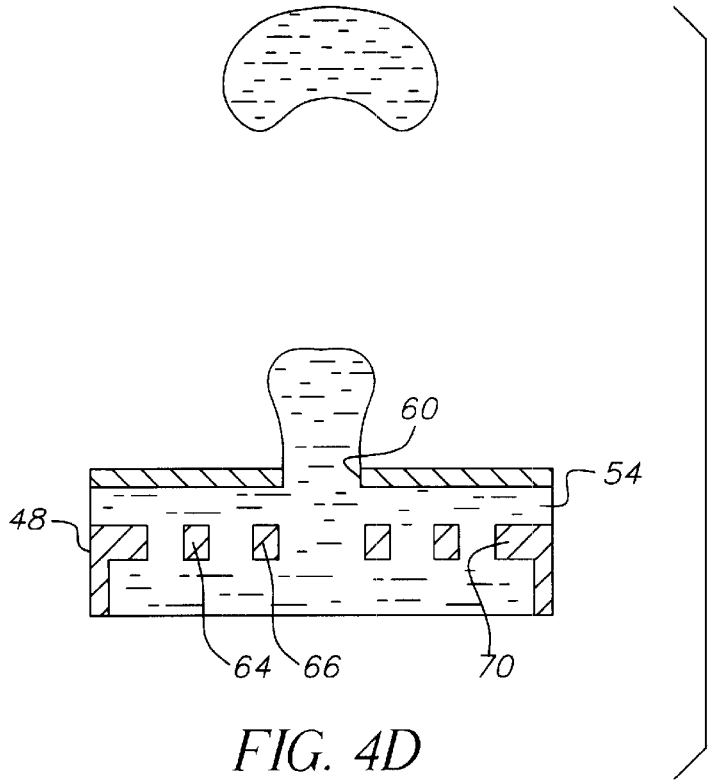

In operation, dye or pigment in a specially formulated thermally-responsive carrier fluid is transported radially inwardly through ink flow passage 54, past nozzle 60 through the micro-capillary grill formed by rings 64 and 66, into reservoir 58. Droplets are emitted from nozzle 60 by applying electrical pulses to heater rings 64 and 66, and to a heater on the inner wall 70 of the circular opening through back substrate 48; causing heat generated by the heaters to be transmitted to the solution. Referring sequentially to FIGS. 4B–4D, the viscosity of the formulated solution increases dramatically when raising the temperature from about 30° C. to about 80° C., as the solutions rapidly form non-fluidic gels at the elevated temperature. The increased viscosity quickly forms a gel, blocking the flow through the micro-capillary grill and increasing the pressure at nozzle 60. The increased pressure overcomes the surface tension on the meniscus, causing a droplet to be generated. An ink droplet is expelled at a high velocity from the nozzle outlet, which in turn causes it to strike its intended position on a printing medium with greater accuracy.

The viscosity change of the formulated solutions in response of temperature change is entirely reversible as the solutions turn to fluidic having the original viscosity when cooled down to its initial temperature. Flow resumes through the micro-capillary grill and the pressure returns to a level incapable of droplet formation.

Figure 5:
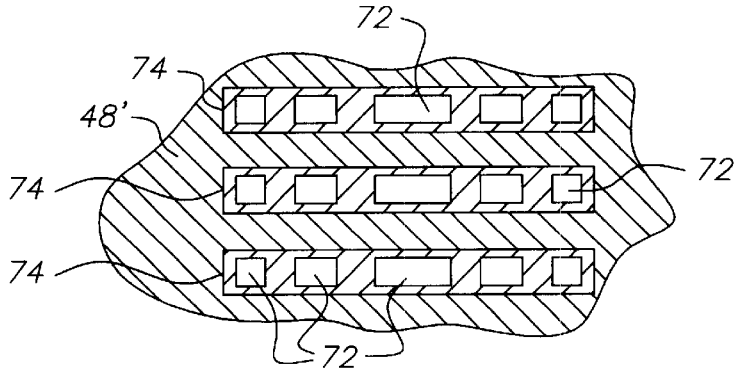
FIG. 5 is a cross-sectional top view similar to FIG. 3 of another embodiment of the present invention.

Referring to FIG. 3, one can appreciate that the spacing between adjacent nozzle openings 60 on a print head must be greater than the diameter of inner wall 70 of the circular opening through back substrate 48. While this spacing would probably be appropriate for most applications, it is to be noted that the micro-capillary for each of a plurality of nozzles can be fabricated as an array of aligned grill passages 72 through back substrate 48', as illustrated in FIG. 5. Each array of aligned grill passages has an associated heater, or heaters, 74. A row or rows of nozzle openings can be positioned orthogonal to the array of grill passages such that the nozzle spacing is reduced.

What is claimed is:

1. A drop on demand ink jet printing system for controlling delivery of inks to a receiver; said system comprising:

an ink flow chamber having (1) a nozzle opening in a wall of said flow chamber through which ink droplets are ejected when ink in said flow chamber, at the nozzle opening, is at or above a predetermined positive pressure, (2) an inlet channel opening into said flow chamber and adapted to transport ink into said flow chamber at or above said predetermined pressure, and (3) an outlet channel communicating said flow chamber with a low pressure ink reservoir, said outlet channel being adapted to normally transport the ink from said flow chamber at a flow velocity sufficient to maintain ink in said flow chamber, at the nozzle opening, at a pressure less than said predetermined positive pressure; and a valve associated with said outlet channel and adapted to selectively restrict the flow of ink through the outlet channel sufficiently to cause an increase in ink pressure in said flow chamber, at the nozzle opening, to at least the predetermined positive pressure, whereby an ink droplet is ejected through the nozzle opening.

2. A microfluidic system for controlling delivery of thermally-responsive fluids; said system comprising:

a fluid flow chamber having (1) a nozzle opening in a wall of said flow chamber through which fluid droplets are ejected when fluid in said flow chamber, at the nozzle opening, is at or above a predetermined positive pressure, (2) an inlet channel opening into said flow chamber and adapted to transport thermally-responsive fluid into said flow chamber at or above said predetermined pressure, and (3) a microfluidic outlet channel communicating said flow chamber with a low pressure reservoir, said outlet channel being adapted to normally transport the thermally-responsive fluid from said flow chamber at a flow velocity sufficient to maintain fluid in said flow chamber, at the nozzle opening, at a pressure less than said predetermined positive pressure; and a valve associated with said microfluidic outlet channel and adapted to selectively restrict the flow of the thermally-responsive fluids through the microfluidic outlet channel sufficiently to cause an increase in fluid pressure in said flow chamber, at the nozzle opening, to at least the predetermined positive pressure, said valve including a heater in contact with at least a portion of the associated microfluidic outlet channel, whereby the viscosity of said thermally-responsive fluid can selectively be increased by heat from said heater to restrict the flow of the thermally-responsive fluid from said flow chamber such that a fluid droplet is ejected through the nozzle opening.

3. A microfluidic system as set forth in claim 2 wherein the fluids comprise a material and a thermally-responsive carrier fluid.

4. A microfluidic system as set forth in claim 2 wherein the microfluidic outlet channel has passages with an internal cross-sectional dimensional between about 0.1 $\mu$m and about 500 $\mu$m.

5. A microfluidic system as set forth in claim 2 wherein the microfluidic outlet channel has passages with an internal cross-sectional dimensional between about 1 $\mu$m and about 200 $\mu$m.

6. A microfluidic system as set forth in claim 2 wherein said thermally-responsive fluid is gelled by heat from said heater.

7. A microfluidic system as set forth in claim 2 wherein said valve includes a micro-capillary grill having a plurality of heater elements in the outlet channel.

8. A microfluidic system as set forth in claim 7 wherein said micro-capillary grill heater elements are arranged as a plurality of heater rings with annular flow openings between the rings.

9. A microfluidic system as set forth in claim 7 wherein said micro-capillary grill heater elements are arranged linearly with an array of aligned flow openings between the heater elements.

10. A drop on demand microfluidic ink jet printing system for controlling delivery of thermally-responsive inks to a receiver, said system comprising:

an ink flow chamber having (1) a nozzle opening in a wall of said flow chamber through which ink droplets are ejected when ink in said flow chamber, at the nozzle opening, is at or above a predetermined positive pressure, (2) an inlet channel opening into said flow chamber and adapted to transport thermally-responsive ink into said flow chamber at or above said predetermined pressure, and (3) a microfluidic outlet channel communicating said flow chamber with a low pressure ink reservoir, said outlet channel being adapted to normally transport the thermally-responsive ink from said flow chamber at a flow velocity sufficient to maintain ink in said flow chamber, at the nozzle opening, at a pressure less than said predetermined positive pressure; and a valve associated with said microfluidic outlet channel and adapted to selectively restrict the flow of the thermally-responsive ink through the microfluidic outlet channel sufficiently to cause an increase in ink pressure in said flow chamber, at the nozzle opening, to at least the predetermined positive pressure, said valve including a heater in contact with at least a portion of the associated microfluidic outlet channel, whereby the viscosity of said thermally-responsive ink can selectively be increased by heat from said heater to restrict the flow of the thermally-responsive ink from said flow chamber such that an ink droplet is ejected through the nozzle opening.

11. A microfluidic system as set forth in claim 10 wherein the fluids comprise a material and a thermally-responsive carrier fluid.

12. A microfluidic system as set forth in claim 10 wherein the microfluidic outlet channel has passages with an internal cross-sectional dimensional between about 0.1 $\mu$m and about 500 $\mu$m.

13. A microfluidic system as set forth in claim 10 wherein the microfluidic outlet channel has passages with an internal cross-sectional dimensional between about 1 $\mu$m and about 100 $\mu$m.

14. A microfluidic system as set forth in claim 10 wherein said thermally-responsive fluid is gelled by heat from said heater.

15. A microfluidic system as set forth in claim 10 wherein said valve includes a micro-capillary grill having a plurality of heater elements in the outlet channel.

16. A microfluidic system as set forth in claim 15 wherein said micro-capillary grill heater elements are arranged as a plurality of heater rings with annular flow openings between the rings.

17. A microfluidic system as set forth in claim 15 wherein said micro-capillary grill heater elements are arranged linearly with an array of aligned flow openings between the heater elements.

* * * * *